US011906244B2

(12) United States Patent
Pierce et al.

(10) Patent No.: US 11,906,244 B2
(45) Date of Patent: Feb. 20, 2024

(54) HYDROCARBON GAS PROCESSING

(71) Applicant: UOP LLC, Des Plaines, IL (US)

(72) Inventors: Michael C. Pierce, Midland, TX (US); Stephen N. Peterson, Midland, TX (US); J. Ascencion Anguiano, Midland, TX (US); Hank M. Hudson, Midland, TX (US); John D. Wilkinson, Midland, TX (US)

(73) Assignee: UOP LLC, Des Plaines, IL (US)

( * ) Notice: Subject to any disclaimer, the term of this patent is extended or adjusted under 35 U.S.C. 154(b) by 25 days.

(21) Appl. No.: 17/528,010

(22) Filed: Nov. 16, 2021

(65) Prior Publication Data

US 2022/0163257 A1 May 26, 2022

Related U.S. Application Data

(60) Provisional application No. 63/156,446, filed on Mar. 4, 2021, provisional application No. 63/117,024, filed on Nov. 23, 2020.

(51) Int. Cl.
*F25J 3/02* (2006.01)
*F25J 1/00* (2006.01)

(52) U.S. Cl.
CPC ..... *F25J 1/0022* (2013.01); *F25J 3/0204* (2013.01); *F25J 3/0233* (2013.01); *F25J 3/0238* (2013.01); *F25J 2200/02* (2013.01); *F25J 2200/92* (2013.01); *F25J 2215/04* (2013.01); *F25J 2215/60* (2013.01); *F25J 2215/62* (2013.01)

(58) Field of Classification Search
CPC ..... F25J 1/0022; F25J 3/0204; F25J 3/0233; F25J 3/0238; F25J 2200/02; F25J 2200/92; F25J 2215/04; F25J 2215/60; F25J 2215/62
See application file for complete search history.

(56) References Cited

U.S. PATENT DOCUMENTS

| | | | |
|---|---|---|---|
| 4,171,964 | A | 10/1979 | Campbell et al. |
| 7,191,617 | B2 | 3/2007 | Cuellar et al. |
| 8,590,340 | B2 | 11/2013 | Pitman et al. |

OTHER PUBLICATIONS

"International Search Report & Written Opinion for H221999-WO", dated Mar. 10, 2022.

*Primary Examiner* — Nael N Babaa
(74) *Attorney, Agent, or Firm* — Paschall & Associates, LLC; Mark Goldberg

(57) ABSTRACT

A process is provided for treating a hydrocarbon gas stream by condensing a portion of the gas stream to produce a liquid stream, then through several steps subcooling a portion of the liquid stream to be introduced into a midpoint into a fractionation column. Unexpectedly, it has been found that the recompression and refrigeration power requirements are substantially reduced and the minimum approach to carbon dioxide freezing are increased when the liquid stream is introduced to a midpoint in the column when compared to introducing the liquid stream to a top position or a lower position in the fractionation column.

18 Claims, 8 Drawing Sheets

HYDROCARBON GAS PROCESSING

This application claims priority from provisional patent applications 63/117,024, filed Nov. 23, 2020, and 63/156,446, filed Mar. 4, 2021, which are incorporated herein in their entireties.

This invention relates to a process for the separation of a gas containing hydrocarbons.

Ethylene, ethane, propylene, propane and heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas may also contain relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 71.0% methane, 15.3% ethane and other $C_2$ components, 8.3% propane and other $C_3$ components, 0.6% iso-butane, 1.3% normal butane, 0.5% pentanes plus, with the balance made up of nitrogen and carbon dioxide. Sulfur-containing gases are also sometimes present. The present invention is particularly useful with gas streams having a higher than normal proportion of hydrocarbons heavier than methane.

The historically cyclic fluctuations in the prices of both natural gas and its natural gas liquid (NGL) constituents have reduced the incremental value of ethane and heavier components as liquid products. This has resulted in a demand for processes that can provide more efficient recoveries of these products. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane and heavier hydrocarbons content) of the gas, and the desired end products, each of these processes or a combination thereof may be employed.

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquid formed, the high-pressure liquids may be expanded to a lower pressure and fractionated. The vaporization occurring during expansion of the liquid results in further cooling of the stream. Under some conditions, pre-cooling the high-pressure liquid prior to the expansion may be desirable in order to further lower the temperature resulting from the expansion. The expanded stream, comprising a mixture of liquid and vapor, is fractionated in a distillation (demethanizer) column. In the column, the expansion cooled stream(s) is (are) distilled to separate residual methane, nitrogen, and other volatile gases as overhead vapor from the desired $C_2$ components, $C_3$ components, and heavier components as bottom liquid product.

If the feed gas is not totally condensed (typically it is not), the vapor remaining from the partial condensation can be split into two or more streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Depending on the amount of high-pressure liquid available, some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier components with essentially no methane or more volatile components. In practice, however, this ideal situation is not obtained for the reason that the conventional demethanizer is operated largely as a stripping column. The methane product of the process, therefore, typically comprises vapors leaving the top fractionation stage of the column, together with vapors not subjected to any rectification step.

The present invention relates to the recovery of ethane and heavier hydrocarbons from a natural gas stream. The benefits of the present invention are particularly applicable to richer natural gas streams containing a higher content of ethane and heavier hydrocarbon components and provides an additional benefit when the carbon dioxide content is high enough to create possible solid carbon dioxide freezing conditions in that the margin from the temperatures at which the carbon dioxide would freeze is increased.

Several cryogenic processes have been described in the prior art that improve the desired product recovery using different techniques. For example, U.S. Pat. No. 5,568,737 teaches that extremely high ethane recovery can be achieved by feeding two reflux streams to a distillation column above the primary feed gas stream which typically flows through an expander before feeding the column. In that case the top reflux stream is very lean, comprised mainly of methane. By contrast, U.S. Pat. No. 4,171,964 teaches that ethane recovery efficiency may be improved by feeding a richer liquid stream as the top reflux stream to the distillation column, and also describes an additional benefit of increased separation from carbon dioxide freezing conditions. U.S. Pat. No.

4,171,964 also teaches the use of an "auto-cooling" system, wherein the liquids from the partially condensed feed gas stream are separated from the vapor portion, cooled in a heat exchanger, and split into two portions. The first portion is flash expanded to a lower pressure, thereby reducing its temperature, and used to cool the entire liquid stream in the aforementioned heat exchanger. The second cooled portion is flash expanded to the distillation column pressure, thereby reducing its temperature further, and fed as the top reflux stream.

In the present invention, the second cooled portion of the "auto-cooled" liquid is fed to a mid-column feed location instead of being used as the top reflux. This supplemental reflux stream may feed the column at or above the feed location of the primary feed gas stream flowing from the expander, or possibly combined with the primary feed gas stream downstream of the expander prior to feeding the column. Combining the two streams is particularly beneficial when the "auto-cooled" liquid stream is colder than the stream leaving the expander. In such cases, additional heavier hydrocarbons are condensed from the vapor fraction leaving the expander. These additional liquids subsequently flow downward in the distillation column, thereby requiring less reflux flow to be provided by the upper reflux stream(s). The decrease in the flow of the upper reflux streams reduces power consumption for a specific hydrocarbon recovery level.

An additional benefit of feeding the "auto-cooled" liquid stream higher in the distillation column is the absorption of carbon dioxide into the liquid fraction. This reduces the carbon dioxide content in the upper section of the column, increasing the safety margin from carbon dioxide freezing.

SUMMARY

An embodiment of the invention is a process for separating a feed gas into a volatile residue gas and a relatively less volatile fraction, the feed gas containing hydrocarbons, methane and ethane together comprising the major portion of the feed gas, wherein the gas under pressure is cooled sufficiently to form a liquid portion under pressure and a vapor portion under pressure. The vapor portion is divided under pressure into first and second streams. The first stream is cooled to substantial condensation and then expanded to a lower pressure, vaporizing part of the first stream and thereby cooling it further before the first stream is supplied to a fractionation column as a top feed thereto. The second stream is expanded to the lower pressure and partially condensed before it is supplied to the fractionation column as a midpoint feed thereto. The liquid portion under pressure is cooled and divided into two portions. The first liquid portion is flash expanded to the lower pressure, whereby a part of the first liquid portion vaporizes to cool the expanded first liquid portion, whereupon it is heated to supply the cooling of the liquid portion. The second liquid portion, now subcooled to a temperature below its bubble point, is expanded to the lower pressure, whereby a portion of the expanded subcooled second liquid portion is partially vaporized to further cool the expanded subcooled second liquid portion. At least a portion of the liquid remaining in the expanded subcooled second liquid portion is supplied to the fractionation column as a midpoint liquid feed thereto.

In another embodiment is an apparatus for separating a feed gas into a volatile residue gas and a relatively less volatile fraction, the feed gas containing hydrocarbons, methane and ethane together comprising the major portion of the feed gas, the apparatus including a first cooling means to receive the feed gas under pressure and to cool it sufficiently to form a liquid portion and a vapor portion. A separation means is connected to the first cooling means to separate the liquid portion under pressure and the vapor portion under pressure. A first dividing means is connected to the separation means to receive the vapor portion under pressure and divide the vapor portion into a first stream and a second stream. A second cooling means is connected to the first dividing means to receive the first stream under pressure and cool the first stream to substantial condensation. A first expansion means is connected to the second cooling means to receive the substantially condensed first stream and expand the substantially condensed first stream to a lower pressure, thereby partially vaporizing the stream and further cooling it. A second expansion means is connected to the first dividing means to receive the second stream under pressure and expand it to the lower pressure, thereby partially condensing the expanded second stream. A heat exchange means is connected to the separation means to receive the liquid portion and subcool it. A second dividing means is connected to the heat exchange means to receive the subcooled liquid portion and to divide it into a first liquid portion and a second liquid portion. A third expansion means is connected to the second dividing means to receive the first liquid portion under pressure and to expand the first liquid portion to the lower pressure, thereby to vaporize a portion of the first liquid portion and to cool the expanded first liquid portion, whereupon it is heated in the heat exchange means. A fractionation means is connected to the first expansion means, the second expansion means, and the third expansion means to receive at least the liquid remaining from the partial vaporization of the expanded substantially condensed first stream, the liquid formed from partial condensation of the expanded second stream, and the liquid remaining from expansion and heating of the first liquid portion, to separate the relatively less volatile fraction. A fourth expansion means is connected to the second dividing means to receive the subcooled second liquid portion and expand it to the lower pressure, thereby to vaporize a portion of said second liquid portion and to cool the expanded second liquid portion. The fourth expansion means is connected to supply at least part of the liquid remaining in the expanded subcooled second liquid portion to the fractionation means at a midpoint feed position.

DETAILED DESCRIPTION

In accordance with the embodiments of the invention to be described herein, the hydrocarbon gas, under pressure, is cooled sufficiently to form a liquid portion, and the liquid portion is expanded to a lower pressure as in the conventional process. Expansion of the liquid portion vaporizes a portion of it and cools the remaining portion, which remains as a liquid. This expanded stream usually is supplied to a fractionation column where it is separated into a top fraction and a bottom fraction. In the present invention, the foregoing process is improved by subcooling the liquid portion and then dividing the subcooled liquid portion into first and second liquid portions. The first liquid portion is expanded to the lower pressure and then directed in heat exchange relation with the liquid portion of the feed stream to subcool the liquid portion. The subcooling of the liquid portion condensed from the feed gas under pressure lowers the temperature attained by the aforementioned second liquid portion after expansion. This expanded subcooled second liquid portion is added to the column at a midpoint instead of the upper portion as was done in the prior art. Midpoint of the distillation or fractionation column (terms used interchangeably within) means a point in the column in the middle 50% of the length of the column and preferably in the middle 33% of the column.

Figure 1:
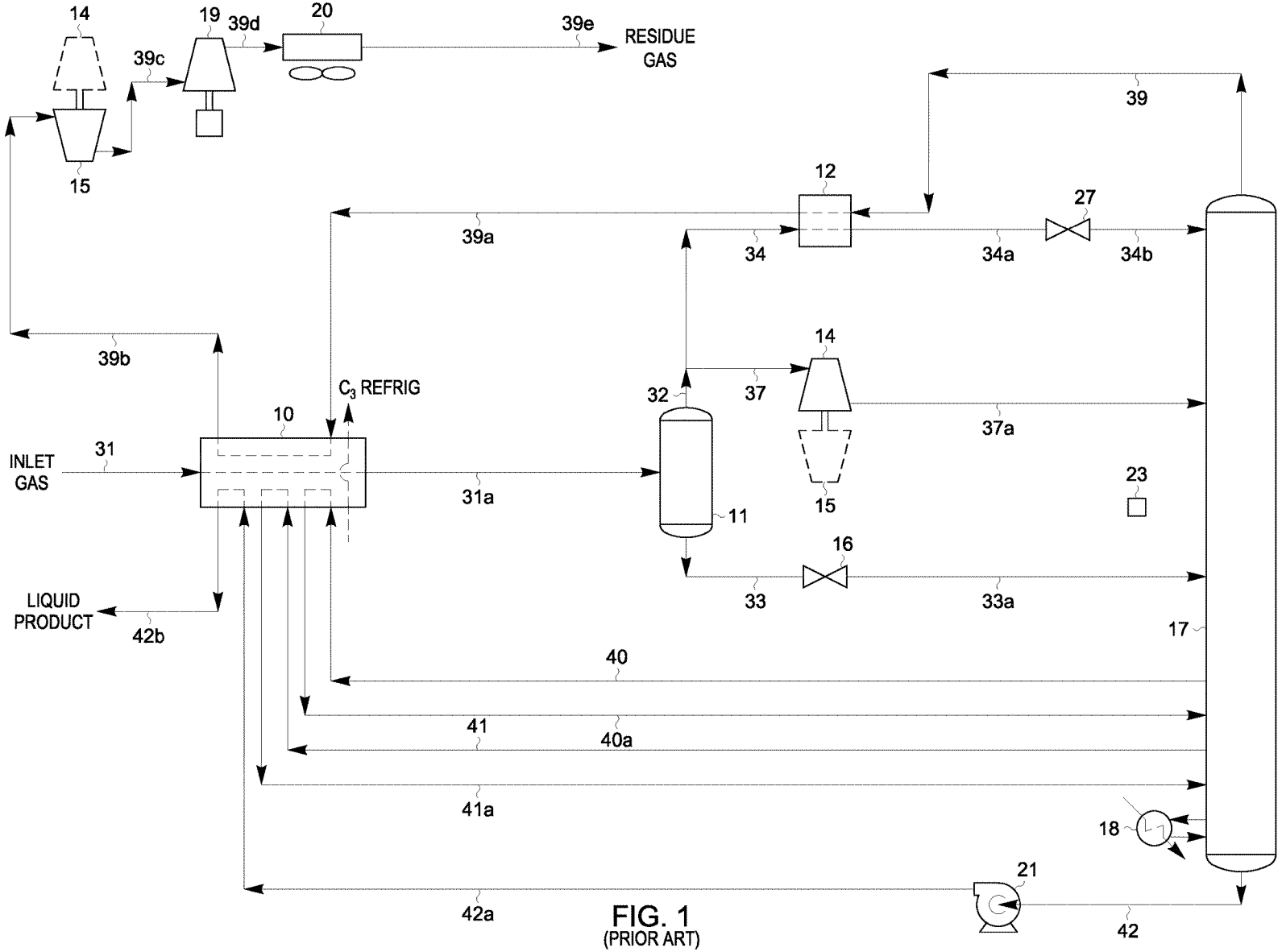
FIG. 1 (PRIOR ART)
FIG. 1 shows a typical prior art flow scheme of a process to treat a hydrocarbon stream that includes a split vapor configuration.

FIG. 1 shows a typical prior art flow scheme in which inlet gas enters the plant at 100° F. and 965 psia as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose. Stream 31 is cooled to −29° F. by heat exchanger 10, which may be a series of coolers as known to one skilled in the art, to produce cooled stream 31*a*, which then enters separator 11 where vapor stream 32 is separated from liquid stream 33. Vapor stream 32 is divided into two streams 34 and 37. Stream 34, containing approximately 51% of the total vapor, is sent through heat exchanger 12 and cooled to −121° F. to become stream 34*a* which is flash expanded by expansion valve 27 down to the operating pressure (371 psia) of fractionation tower 17, cooling stream 34*b* to −137° F. before it is supplied to the tower as the top column feed. Fractionation tower 17 is a demethanizer column that is a conventional distillation column containing a plurality of vertically spaced trays, one or more packed beds, or some combination of trays and packing. As is often the case in natural gas processing plants, the fractionation tower may consist of two sections. The upper section is a separator wherein the partially vaporized top feed is divided into its respective vapor and liquid portions, and wherein the vapor rising from the lower distillation or demethanizing section is combined with the vapor portion of the top feed to form the cold residue gas distillation stream 39 which exits the top of the tower at −126° F. The lower, demethanizing section contains the trays and/or packing and provides the necessary contact between the liquids falling downward and the vapors rising upward. The demethanizing section also includes reboilers which heat and vaporize a portion of the liquids flowing down the column to provide the stripping vapors which flow up the column.

The remaining portion of stream 32, stream 37, is expanded to the column operating pressure by expansion machine 14 to produce stream 37*a* at −93° F. that is sent to fractionation column 17 at a mid-column feed position. Liquid stream 33 is flash expanded to the column operating pressure by expansion valve 16 to form stream 33*a* at −75° F. which is supplied to fractionation column 17 at a lower mid-column feed position. A liquid stream 40 is withdrawn from fractionation column 17 to be heated in heat exchanger 10 and returned to fractionation column 17 in stream 40*a* to provide a portion of the reboiling heat to the column. Liquid stream 41 also is withdrawn from fractionation column 17 to be heated in heat exchanger 10 and returned to the fractionation column in stream 41*a* to provide another portion of the reboiling heat to the column. Some applications may also include supplemental reboiler 18 for fractionation column 17.

The liquid product stream 42 exits the bottom of the tower at 59° F., with its temperature adjusted by control means 23 to meet a typical specification of a methane to ethane ratio of 0.05:1 on a molar basis in the bottom product. The stream is pumped to higher pressure (stream 42*a*) by pump 21 and warmed to 88° F. (stream 42*b*) in heat exchanger 10 as it provides cooling to stream 31. (The discharge pressure of the pump is usually set by the ultimate destination of the liquid product. Generally, the liquid product flows to storage and the pump discharge pressure is set so as to prevent any vaporization of stream 42*a* as it is warmed in heat exchanger 10.)

Residue gas stream 39 passes to heat exchanger 12 where it is heated to −34° F. (stream 39*a*), and to heat exchanger 10 where it is further heated to 88° F. (stream 39*b*). Stream 39*b* is passed to compressor 15 (driven by expansion machine 14) to produce partially compressed stream 39*c*, which is further compressed in compressor 19 to produce compressed stream 39*d* and cooled in cooler 20 to produce residue gas stream 39*e* at 140° F. and 765 psia.

A summary of stream flow rates and energy consumption for the process illustrated in FIG. 1 is set forth in the following Table I

TABLE I (FIG. 1)
Stream Flow Summary - Lb. Moles/Hr

| Stream | Methane | Ethane | Propane | Butanes+ | Total |
|---|---|---|---|---|---|
| 31 | 62,369 | 13,440 | 7,291 | 2,082 | 87,844 |
| 32 | 37,767 | 4,430 | 1,288 | 172 | 44,978 |
| 33 | 24,602 | 9,010 | 6,003 | 1,910 | 42,866 |
| 34 | 19,362 | 2,271 | 660 | 88 | 23,059 |
| 37 | 18,405 | 2,159 | 628 | 84 | 21,919 |
| 39 | 61,771 | 1,476 | 48 | 1 | 64,921 |
| 42 | 598 | 11,964 | 7,243 | 2,081 | 22,923 |
| Recoveries* | | | | | |
| Ethane | 89.02% | | | | |
| Propane | 99.34% | | | | |
| Butanes+ | 99.95% | | | | |
| Power | | | | | |
| Residue Gas Compression | 25,738 | HP | | | |
| Refrigerant Compression | 18,724 | HP | | | |
| Total Compression | 44,462 | HP | | | |

*(Based on un-rounded flow rates)

Figure 2:
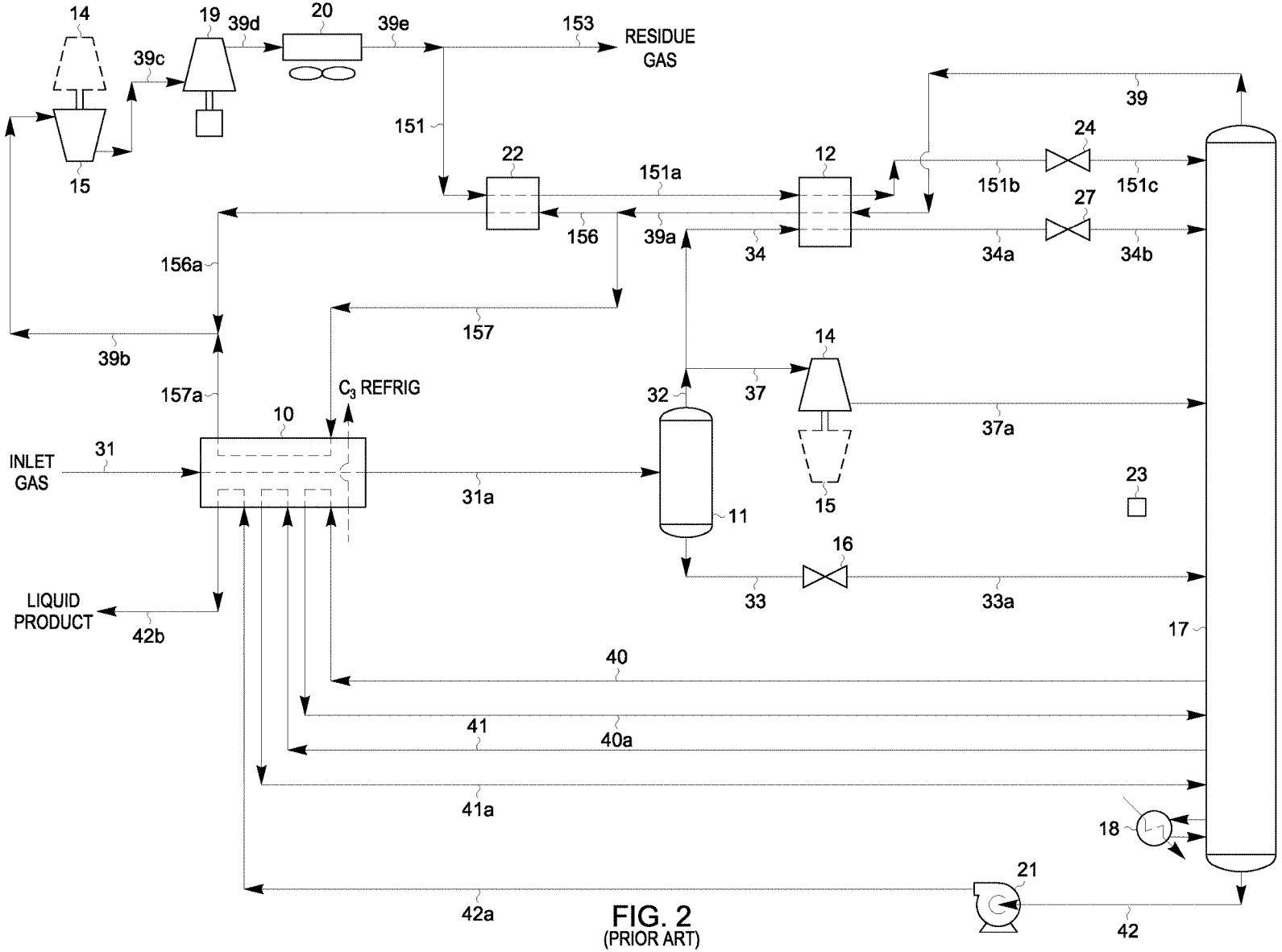
FIG. 2 (PRIOR ART)
FIG. 2 shows a typical prior art flow scheme of a process to treat a hydrocarbon stream that includes a recycle split vapor configuration.

FIG. 2 shows another typical prior art flow scheme which adds a recycle stream to the split vapor process of FIG. 1. As in FIG. 1, inlet gas enters the plant at 100° F. and 965 psia as stream 31. Stream 31 is cooled to −30° F. in heat exchanger 10 and cooled stream 31*a* enters separator 11 where the vapor (stream 32) is separated from the condensed liquid (stream 33). The vapor (stream 32) from separator 11 is divided into two streams, 34 and 37. Stream 34, containing about 36% of the total vapor, passes through heat exchanger 12 where it is cooled to substantial condensation. The resulting substantially condensed stream 34*a* at −135° F. is then flash expanded by expansion valve 27 to the operating pressure (approximately 351 psia) of fractionation tower 17, whereupon stream 34*b* is supplied to fractionation tower 17 at an upper mid-column feed position. The remaining portion of the vapor from separator 11 (stream 37) enters work expansion machine 14 and is expanded to the tower operating pressure, with the work expansion cooling the expanded stream 37*a* to about −97° F. before it is supplied to fractionation tower 17 at a mid-column feed position. Liquid stream 33 from separator 11 is flash expanded to the column operating pressure by expansion valve 16 to form stream 33*a* at −78° F. which is supplied to fractionation column 17 at a lower mid-column feed position.

The recompressed and cooled distillation stream 39*e* is divided into two streams. One portion, stream 153, is the volatile residue gas product. The other portion, recycle stream 151, flows to heat exchanger 22 where it is cooled to −29° F. by heat exchange with a portion (stream 156) of cool distillation stream 39*a*. The cooled recycle stream 151*a* then flows to exchanger 12 where it is cooled to −135° F. and substantially condensed by heat exchange with cold distillation stream 39 at −142° F. The substantially condensed stream 151*b* is then flash expanded by expansion valve 24 to the tower operating pressure, resulting in cooling of the total stream to −149° F. The expanded stream 151*c* is then supplied to fractionation tower 17 as the top column feed. The vapor portion of stream 151*c* combines with the vapors rising from the top fractionation stage of the column to form distillation stream 39, which is withdrawn from an upper region of the tower.

Liquid product stream 42 exits the bottom of the tower at 52° F., based on a methane to ethane ratio of 0.05:1 on a molar basis in the bottom product. It is pumped by demethanizer bottoms pump 21, and the pumped liquid product is then warmed to 90° F. as it provides cooling of stream 31 in exchanger 10 before flowing to storage.

The demethanizer overhead vapor (stream 39) passes countercurrently to the incoming feed gas and recycle streams in heat exchanger 12 where it is heated from −140° F. to −38° F. (stream 39*a*), and in heat exchanger 22 and heat exchanger 10 where it is heated to 100° F. (stream 39*b*). The distillation stream is then re-compressed by compressor 15 (driven by expansion machine 14) and compressor 19, then cooled to 140° F. in cooler 20 (stream 39*e*). Stream 39*e* is split into the residue gas product (stream 153) and recycle stream 151 as described earlier before residue gas stream 153 flows to the sales gas pipeline at 765 psia.

A summary of stream flow rates and energy consumption for the process illustrated in FIG. 2 is set forth in the following table:

TABLE II (FIG. 2)
Stream Flow Summary - Lb. Moles/Hr

| Stream | Methane | Ethane | Propane | Butanes+ | Total |
|---|---|---|---|---|---|
| 31 | 62,369 | 13,440 | 7,291 | 2,082 | 87,844 |
| 32 | 36,952 | 4,279 | 1,237 | 165 | 43,919 |
| 33 | 25,417 | 9,161 | 6,054 | 1,917 | 43,925 |
| 34 | 13,230 | 1,532 | 443 | 59 | 15,724 |
| 37 | 23,722 | 2,747 | 794 | 106 | 28,195 |
| 39 | 73,688 | 802 | 0 | 0 | 76,330 |
| 151 | 11,957 | 130 | 0 | 0 | 12,386 |
| 153 | 61,731 | 672 | 0 | 0 | 63,944 |
| 42 | 638 | 12,768 | 7,291 | 2,082 | 23,900 |
| Recoveries* | | | | | |
| Ethane | 95.00% | | | | |
| Propane | 100.00% | | | | |
| Butanes+ | 100.00% | | | | |
| Power | | | | | |

TABLE II-continued (FIG. 2)
Stream Flow Summary - Lb. Moles/Hr

| Stream | Methane | Ethane | Propane | Butanes+ | Total |
|---|---|---|---|---|---|
| Residue Gas Compression | 33,523 | HP | | | |
| Refrigerant Compression | 16,422 | HP | | | |
| Total Compression | 49,945 | HP | | | |

*(Based on un-rounded flow rates)

Figure 3:
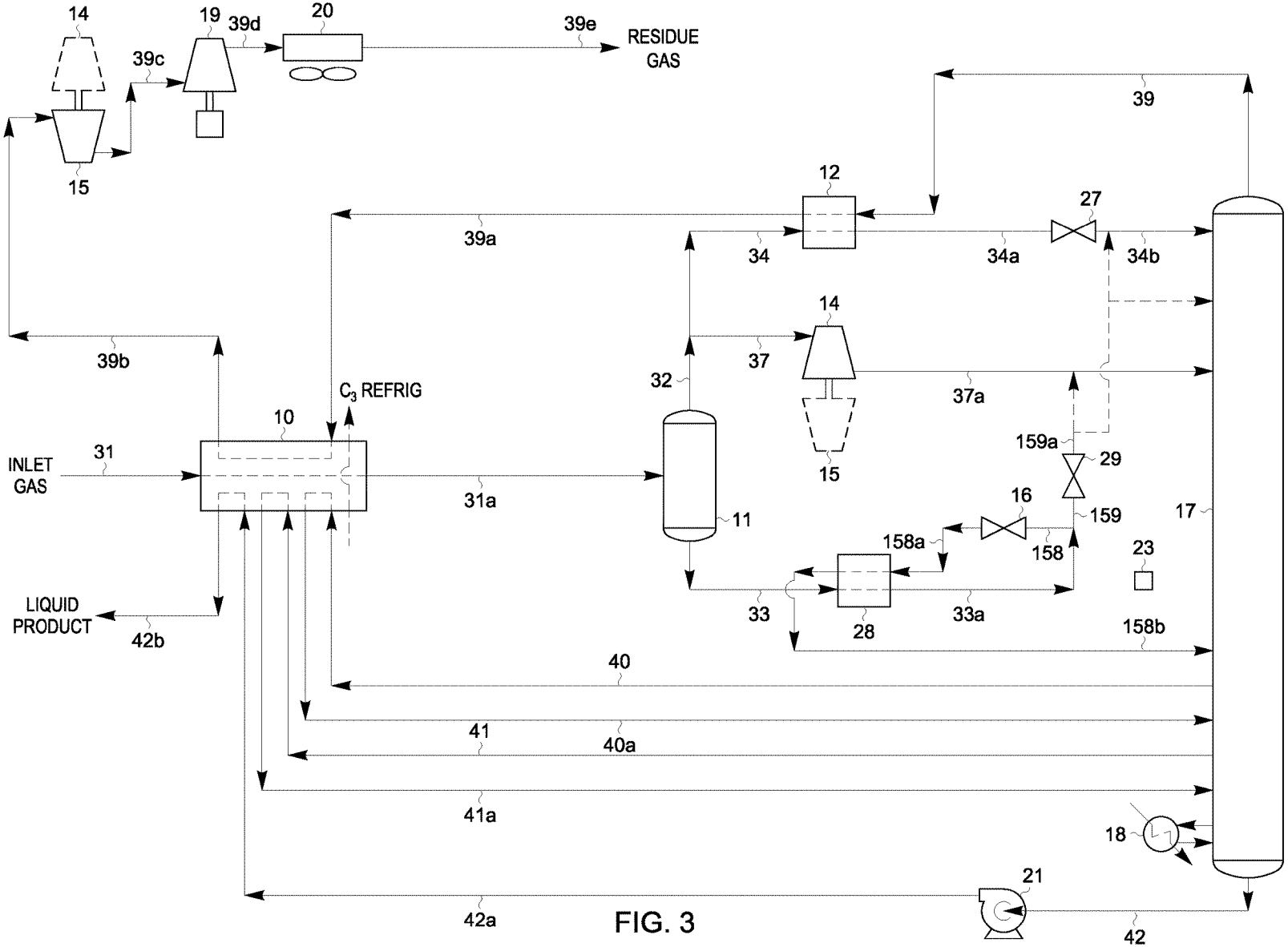
FIGS. 3, 5, and 7 show embodiments of the disclosure in which a subcooled liquid stream is added to a midpoint in a fractionation column.

FIG. 3 shows a flow scheme of the present invention in which a cooled liquid is introduced into a middle section of the fractionation column. The difference from the prior art flow scheme of FIG. 1 is that liquid stream 33 is first cooled in heat exchanger 28 to produce subcooled stream 33*a*. A portion of this stream, stream 158, is expanded to the column operating pressure by expansion valve 16 to produce stream 158*a* that enters heat exchanger 28 to be used as the cooling medium, and the resulting heated stream 158*b* is then supplied to fractionation column 17 at a lower mid-column feed position. The remaining portion of stream 33*a*, stream 159, is flash expanded to the column operating pressure by expansion valve 29 and then supplied to fractionation column 17 at an upper mid-column feed position.

As in FIG. 1, inlet gas enters the plant at 100° F. and 965 psia as stream 31. Stream 31 is cooled to −22° F. in heat exchanger 10 and cooled stream 31*a* enters separator 11 where the vapor (stream 32) is separated from the condensed liquid (stream 33). The vapor (stream 32) from separator 11 is divided into two streams, 34 and 37. Stream 34, containing about 47% of the total vapor, passes through heat exchanger 12 where it is cooled to substantial condensation. The resulting substantially condensed stream 34*a* at −115° F. is then flash expanded by expansion valve 27 to the operating pressure (approximately 430 psia) of fractionation tower 17, whereupon stream 34*b* is supplied to fractionation tower 17 at a top column feed position. The remaining portion of the vapor from separator 11 (stream 37) enters work expansion machine 14 and is expanded to the tower operating pressure, with the work expansion cooling the expanded stream 37*a* to about −77° F. before it is supplied to fractionation tower 17 at a mid-column feed position.

The separator liquid (stream 33) is cooled to −92° F. in heat exchanger 28, and cooled liquid stream 33*a* is then divided into two streams, stream 158 and stream 159. Stream 158 is expanded to slightly above the operating pressure of fractionation tower 17 by expansion valve 16, cooling stream 158*a* to −97° F. before it is heated as it supplies the cooling in heat exchanger 28. The warmed stream 158*b* at −27° F. is then supplied to fractionation tower 17 at a lower mid-column feed position.

The remaining portion of cooled liquid stream 33*a*, stream 159, is flash expanded to the operating pressure of demethanizer 17 by expansion valve 29. A portion of the stream is vaporized, further cooling stream 159*a* to −98° F. before it is supplied to fractionation tower 17 at a mid-column feed position. The cold liquid in stream 159*a* serves as reflux to absorb and condense the $C_2$ components, $C_3$ components, and heavier components rising in the upper region of demethanizer 17.

Liquid product stream 42 exits the bottom of the tower at 72° F. based on a typical specification of a methane to ethane ratio of 0.05:1 on a molar basis in the bottom product. It is pumped to a pressure of approximately 515 psia in demethanizer bottoms pump 21, and the pumped liquid product is then warmed to 77° F. as it provides cooling of stream 31 in exchanger 10 before flowing to storage.

The residue gas (demethanizer overhead vapor stream 39) passes countercurrently to the incoming feed gas in heat exchanger 12 where it is heated from −120° F. to −27° F. (stream 39*a*), and in heat exchanger 10 where it is heated to 81° F. (stream 39*b*). Stream 39*b* is then re-compressed by compressor 15 (driven by expansion machine 14) and compressor 19, then cooled to 140° F. in cooler 20 before residue gas stream 39*e* flows to the sales gas pipeline at 765 psia.

A summary of stream flow rates and energy consumption for the process illustrated in FIG. 3 is set forth in the following Table III:

TABLE III (FIG. 3)
Stream Flow Summary - Lb. Moles/Hr

| Stream | Methane | Ethane | Propane | Butanes+ | Total |
|---|---|---|---|---|---|
| 31 | 62,369 | 13,440 | 7,291 | 2,082 | 87,844 |
| 32 | 42,686 | 5,460 | 1,662 | 227 | 51,573 |
| 33 | 19,683 | 7,980 | 5,629 | 1,855 | 36,271 |
| 34 | 19,849 | 2,539 | 773 | 106 | 23,981 |
| 37 | 22,837 | 2,921 | 889 | 121 | 27,592 |
| 158 | 11,396 | 4,620 | 3,259 | 1,074 | 21,000 |
| 159 | 8,287 | 3,360 | 2,370 | 781 | 15,271 |
| 39 | 61,771 | 1,473 | 67 | 2 | 64,732 |
| 42 | 598 | 11,967 | 7,224 | 2,080 | 23,112 |
| Recoveries* | | | | | |
| Ethane | 89.04% | | | | |
| Propane | 99.08% | | | | |
| Butanes+ | 99.91% | | | | |
| Power | | | | | |
| Residue Gas Compression | 18,554 | HP | | | |
| Refrigerant Compression | 21,634 | HP | | | |
| Total Compression | 40,188 | HP | | | |

*(Based on un-rounded flow rates)

A comparison of Tables I and III shows that, compared to the prior art, the present invention maintains essentially the same ethane recovery (89.02% versus 89.04%), propane recovery (99.34% versus 99.08%), and butanes+recovery (99.95% versus 99.91%). However, comparison of Tables I and III further shows that these yields were achieved with substantially lower power requirements than those of the prior art process. The total power requirement of the present invention is 10% lower than that of the FIG. 1 process.

The key feature of the present invention is the supplemental rectification provided by subcooled liquid stream 159*a*, which reduces the amount of $C_2$ components, $C_3$ components, and $C_4$+ components contained in the vapors rising in the upper region of fractionation column 17. Whereas all the liquid (stream 33) from separator 11 is supplied below the feed (stream 37*a*) from work expansion machine 14 in the FIG. 1 process, the embodiment of the present invention in FIG. 3 is able to cool more than 40% of this liquid and use it as reflux (stream 159*a*) above stream 37*a*. This allows operating separator 11 at a warmer temperature, so that there is a corresponding increase in the flow rate of stream 37 to work expansion machine 14. This in turn provides a two-fold improvement in the process efficiency. First, with more flow to expansion machine 14, the increase in power recovery increases the refrigeration generated by the process. Second, the greater power recovery means more power available to compressor 15, reducing the external power consumption of compressor 19.

Figure 4:
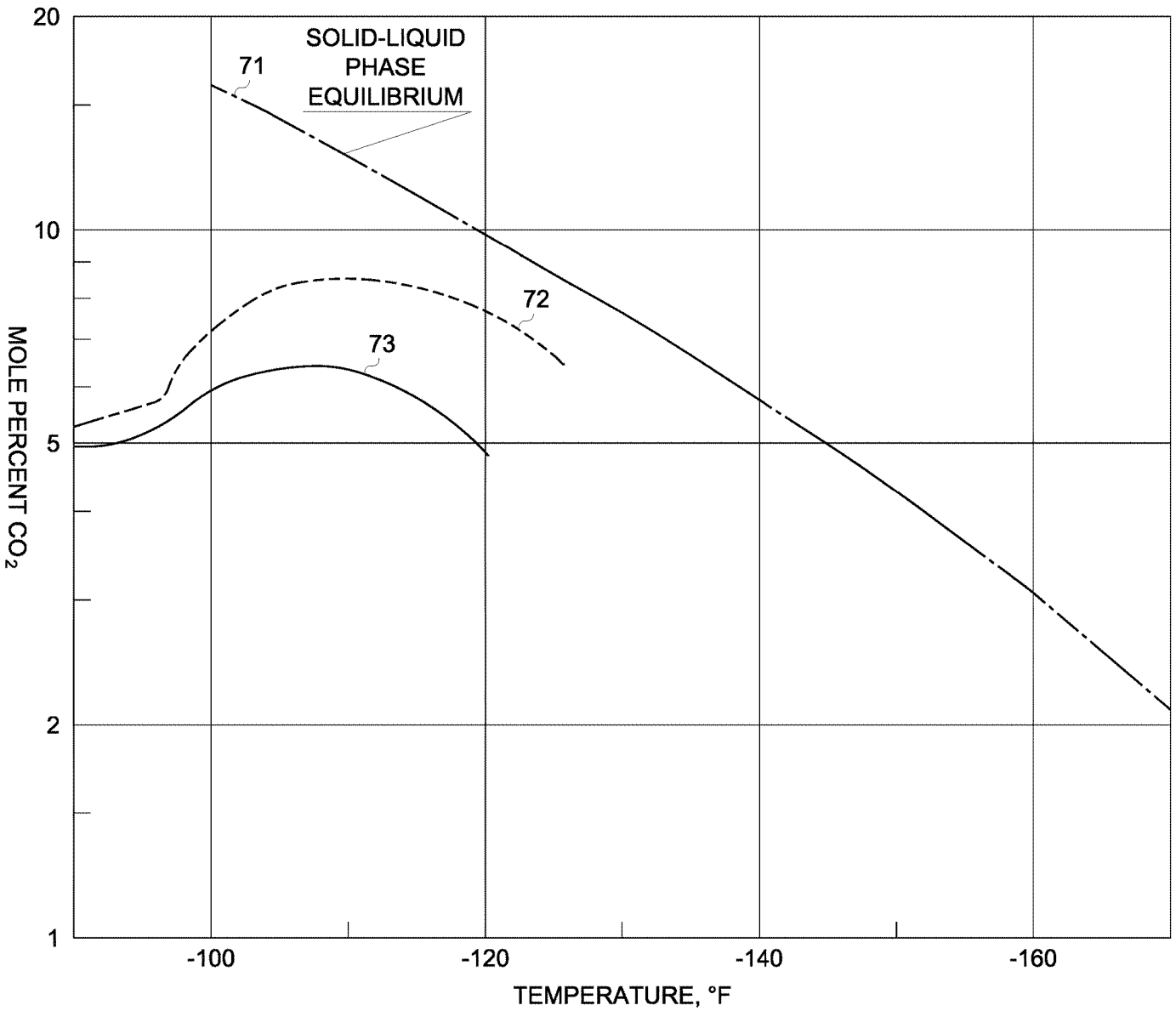
FIGS. 4, 6, and 8 are concentration-temperature diagrams for carbon dioxide showing the effect of the prior art flow schemes and the present invention.

A further advantage of the present invention is a reduced likelihood of carbon dioxide freezing. FIG. 4 is a graph of the relation between carbon dioxide concentration and temperature. Line 71 represents the equilibrium conditions for solid and liquid carbon dioxide in methane. (The liquid-solid equilibrium line in this graph is based on the data given in FIG. 16-33 on page 16-24 of the *Engineering Data Book*, Twelfth Edition, published in 2004 by the Gas Processors Suppliers Association.) A liquid temperature on or to the right of line 71, or a carbon dioxide concentration on or above this line, signifies a freezing condition. Because of the variations which normally occur in gas processing facilities (e.g., feed gas composition, conditions, and flow rate), it is usually desired to design a demethanizer with a considerable safety factor between the expected operating conditions and the freezing conditions. (Experience has shown that the conditions of the liquids on the fractionation stages of a demethanizer, rather than the conditions of the vapors, govern the allowable operating conditions in most demethanizers. For this reason, the corresponding vapor-solid equilibrium line is not shown in FIG. 4.)

Also plotted in FIG. 4 is a line representing the conditions for the liquids on the fractionation stages of demethanizer 17 in the FIG. 1 process (line 72). As can be seen, a portion of this operating line lies relatively close to the liquid-solid equilibrium line, indicating that the FIG. 1 process could easily encounter carbon dioxide freezing problems during variations in operating conditions. Increasing the operating margin would require removal of at least some of the carbon dioxide from the feed gas. This would, of course, substantially increase capital cost.

Line 73 in FIG. 4 represents the conditions for the liquids on the fractionation stages of demethanizer 17 in the present invention as depicted in FIG. 3. In contrast to the FIG. 1 process, there is a minimum safety factor of 2.0 between the anticipated operating conditions and the freezing conditions for the FIG. 3 process. That is, it would require a 100 percent increase in the carbon dioxide content of the liquids to cause freezing. Thus, the present invention could tolerate a 100% higher concentration of carbon dioxide in its feed gas than the FIG. 1 process could tolerate without risk of freezing. Further, whereas the FIG. 1 process cannot be operated to achieve more than the recovery levels given in Table I because of freezing, the present invention could in fact be operated at even higher recovery levels than those given in Table III without risk of freezing.

The shift in the operating conditions of the FIG. 3 demethanizer as indicated by line 73 in FIG. 4 can be understood by comparing the distinguishing features of the present invention to the prior art process of FIG. 1. While the shape of the operating line for the FIG. 1 process (line 72) is similar to the shape of the operating line for the present invention (line 73), there are two key differences. One difference is that the operating temperatures of the critical upper fractionation stages in the demethanizer in the FIG. 3 process are warmer than those of the corresponding fractionation stages in the demethanizer in the FIG. 1 process, effectively shifting the operating line of the FIG. 3 process away from the liquid-solid equilibrium line. The warmer temperatures of the fractionation stages in the FIG. 3 demethanizer are partly the result of operating the tower at higher pressure than the FIG. 1 process.

The more significant difference between the two operating lines in FIG. 4, however, is the much lower concentrations of carbon dioxide in the liquids on the fractionation stages of demethanizer 17 in the FIG. 3 process compared to those of demethanizer 17 in the FIG. 1 process. One of the inherent features in the operation of a demethanizer column to recover $C_2$ components is that the column must fractionate between the methane that is to leave the tower in its overhead product (vapor stream 39) and the $C_2$ components that are to leave the tower in its bottom product (liquid stream 42). However, the relative volatility of carbon dioxide lies between that of methane and $C_2$ components, causing the carbon dioxide to appear in both terminal streams. Further, carbon dioxide and ethane form an azeotrope, resulting in a tendency for carbon dioxide to accumulate in the intermediate fractionation stages of the column and thereby cause large concentrations of carbon dioxide to develop in the tower liquids.

It is well known that adding a third component is often an effective means for "breaking" an azeotrope. As noted in U.S. Pat. No. 4,318,723, $C_3$-$C_6$ alkane hydrocarbons, particularly n-butane, are effective in modifying the behavior of carbon dioxide in hydrocarbon mixtures. Experience has shown that the composition of the upper mid-column feed (i.e., stream 159*a* in FIG. 3) to demethanizers of this type has significant impact on the composition of the liquids on the crucial fractionation stages in the upper section of the demethanizer. Examining this stream in Table III, note that the $C_3$+ component and $C_4$+ component concentrations for the FIG. 3 process are greater than 20% and 5%, respectively. The net impact of this is to "break" the azeotrope and reduce the carbon dioxide concentrations in the column liquids accordingly. A further impact of the higher concentrations of $C_3$+ components and $C_4$+ components in the liquids on the fractionation stages of demethanizer 17 in the FIG. 3 process is to raise the bubble point temperatures of the tray liquids, adding to the favorable shift of operating line 73 for the FIG. 3 process away from the liquid-solid equilibrium line in FIG. 4.

In the present invention, the second cooled portion of the "auto-cooled" liquid (stream 159) is flash expanded and fed to an upper mid-column feed position or an intermediate upper mid-column feed position. This supplemental reflux stream feeds the column at or above the feed location of expanded stream 37*a*. In some embodiments, the subcooled liquid portion that is feeding the fractionation column may be mixed with expanded subcooled stream 34*b* with similar results. In other embodiments, the subcooled liquid portion can be combined with stream 37*a* downstream of work expansion machine 14 prior to feeding the column. Combining these two streams is particularly beneficial when the "auto-cooled" liquid stream is colder than the stream leaving the expander. In that case, additional heavier hydrocarbons are condensed from the vapor fraction leaving the expander. These additional liquids subsequently flow downward in the distillation column, thereby requiring less reflux flow to be provided by the upper reflux stream. The decrease in the flow rates of the upper reflux stream reduces power consumption for a specific hydrocarbon recovery level.

Figure 5:
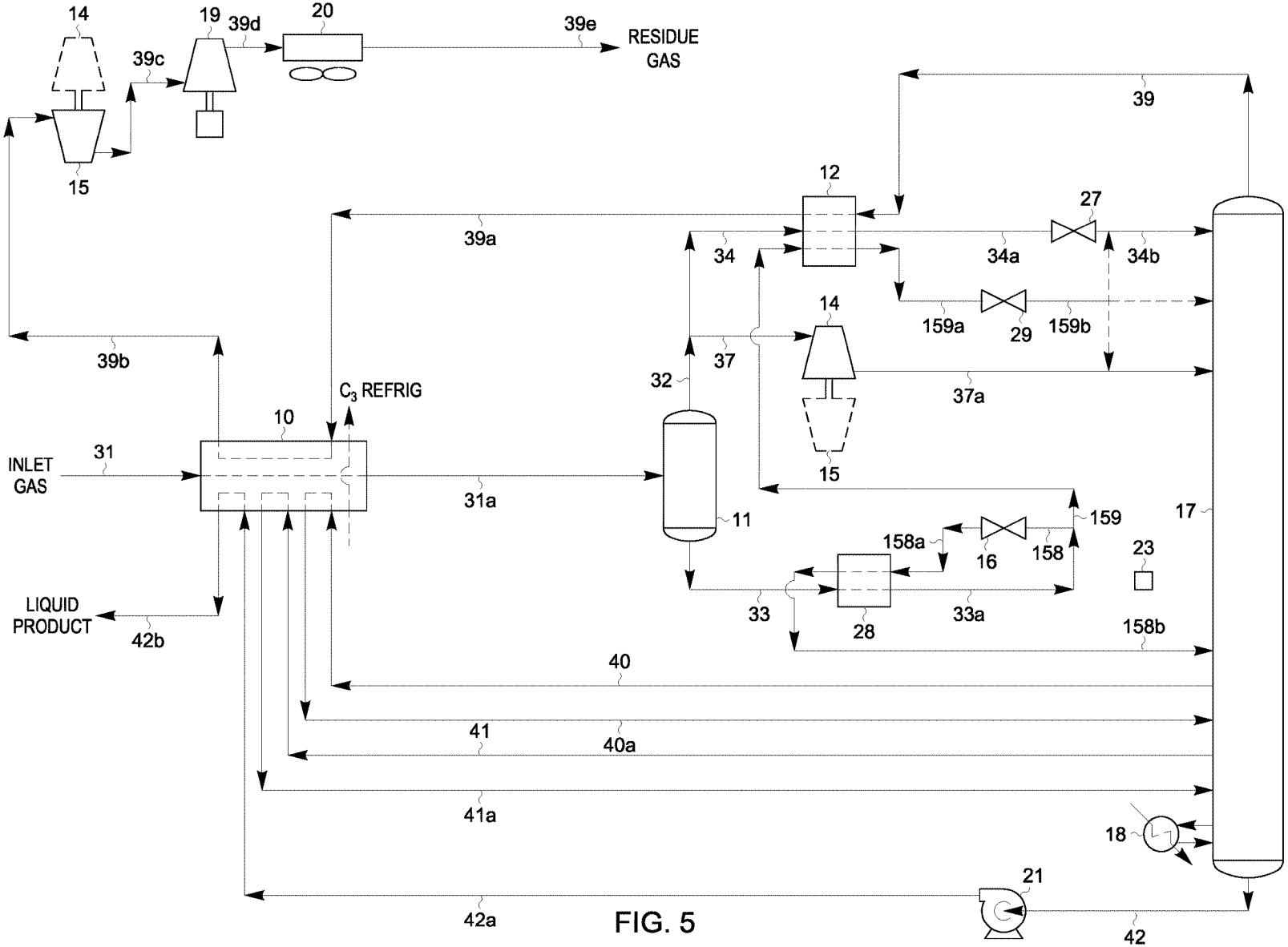

Another embodiment of the present invention is shown in FIG. 5. The processing conditions are much the same as for the FIG. 3 embodiment, except that the subcooled liquid portion (stream 159) is further cooled before being flash expanded to the tower pressure. In this example, stream 159 is cooled from −93° F. to −116° F. in heat exchanger 12, and stream 159*a* is then flash expanded by expansion valve 29 to form stream 159*b* at −114° F. that is thereafter supplied to fractionation column 17 at a mid-column feed position.

A summary of stream flow rates and energy consumption for the process illustrated in FIG. 5 is set forth in the following Table IV:

TABLE IV (FIG. 5)
Stream Flow Summary - Lb. Moles/Hr

| Stream | Methane | Ethane | Propane | Butanes+ | Total |
|---|---|---|---|---|---|
| 31 | 62,369 | 13,440 | 7,291 | 2,082 | 87,844 |
| 32 | 42,686 | 5,460 | 1,662 | 227 | 51,573 |
| 33 | 19,683 | 7,980 | 5,629 | 1,855 | 36,271 |
| 34 | 17,741 | 2,269 | 691 | 94 | 21,434 |
| 37 | 24,945 | 3,191 | 971 | 133 | 30,139 |
| 158 | 11,390 | 4,618 | 3,257 | 1,073 | 20,990 |
| 159 | 8,293 | 3,362 | 2,372 | 782 | 15,281 |
| 39 | 61,771 | 1,473 | 66 | 2 | 64,714 |
| 42 | 598 | 11,967 | 7,225 | 2,080 | 23,130 |
| Recoveries* | | | | | |
| Ethane | 89.04% | | | | |
| Propane | 99.10% | | | | |
| Butanes+ | 99.91% | | | | |
| Power | | | | | |
| Residue Gas Compression | 18,652 | HP | | | |
| Refrigerant Compression | 21,304 | HP | | | |
| Total Compression | 39,956 | HP | | | |

*(Based on un-rounded flow rates)

A comparison of Tables III and IV shows that this embodiment of the present invention achieves essentially the same ethane recovery (89.04% versus 89.04%), propane recovery (99.08% versus 99.10%), and butanes+recovery (99.91% versus 99.91%). Comparison of Tables III and IV further shows that these yields were achieved with still lower power requirements, dropping the total power requirement by an additional 0.5% relative to the FIG. 1 prior art process. This is due to the improved rectification provided in the upper region of fractionation column 17 by the colder liquid (stream 159*b*). This allows a reduction in the reflux (stream 34*b*) to the top of the column and a corresponding increase in the flow to work expansion machine 14, generating more power and providing more refrigeration to the process, thereby reducing the total compression power.

Figure 6:
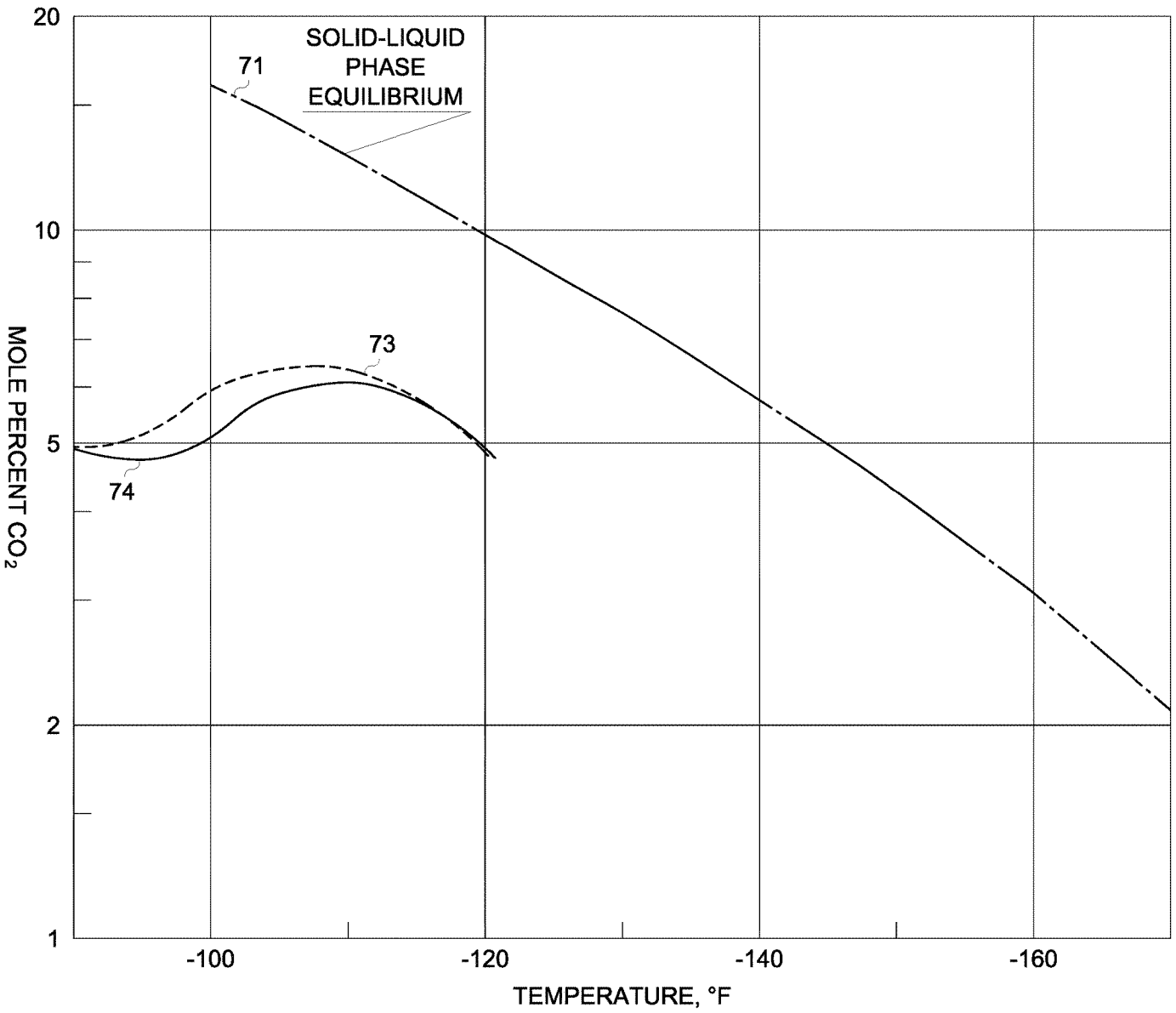

More importantly, the colder liquid feeding the upper mid-column region of fractionation tower 17 serves to further suppress accumulation of carbon dioxide in the upper stages of the column. FIG. 6 is another graph of the relation between carbon dioxide concentration and temperature, with line 71 as before representing the equilibrium conditions for solid and liquid carbon dioxide in methane and line 73 representing the conditions for the liquids on the fractionation stages of demethanizer 17 in the FIG. 3 embodiment of the present invention. Line 74 represents the conditions for the liquids on the fractionation stages of demethanizer 17 in this FIG. 5 embodiment of the present invention, and it lies below line 73. This means this embodiment could tolerate still higher concentrations of carbon dioxide in its feed gas than the embodiment in FIG. 3 without risk of freezing.

Figure 7:
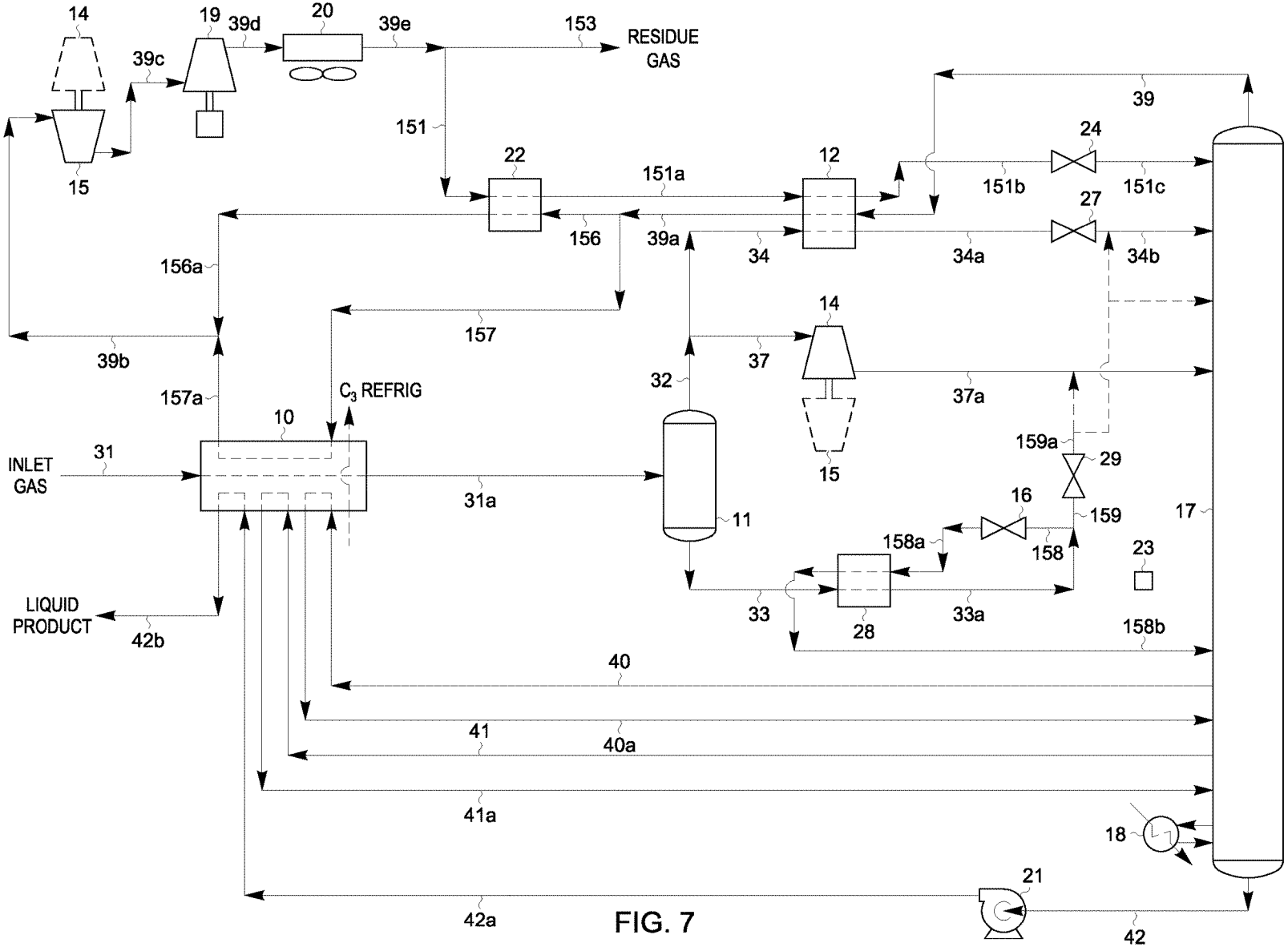

FIG. 7 is an example of how the present invention can be used to improve the prior art of the process in FIG. 2. As in FIG. 2, inlet gas enters the plant at 100° F. and 965 psia as stream 31. Stream 31 is cooled to −20° F. in heat exchanger 10 and cooled stream 31*a* enters separator 11 where the vapor (stream 32) is separated from the condensed liquid (stream 33). The vapor (stream 32) from separator 11 is divided into two streams, 34 and 37. Stream 34, containing about 32% of the total vapor, passes through heat exchanger 12 where it is cooled to substantial condensation. The resulting substantially condensed stream 34*a* at −131° F. is then flash expanded by expansion valve 27 to the operating pressure (approximately 390 psia) of fractionation tower 17, whereupon stream 34*b* is supplied to fractionation tower 17 at an upper mid-column feed position. The remaining portion of the vapor from separator 11 (stream 37) enters work expansion machine 14 and is expanded to the tower operating pressure, with the work expansion cooling the expanded stream 37*a* to about −81° F. before it is supplied to fractionation tower 17 at a mid-column feed position.

The separator liquid (stream 33) is cooled to −98° F. in heat exchanger 28, and cooled liquid stream 33*a* is then divided into two streams, stream 158 and stream 159. Stream 158 is expanded to slightly above the operating pressure of fractionation tower 17 by expansion valve 16, cooling stream 158*a* to −103° F. before it is heated as it supplies the cooling in heat exchanger 28. The warmed stream 158*b* at −25° F. is then supplied to fractionation tower 17 at a lower mid-column feed position.

The remaining portion of cooled liquid stream 33*a*, stream 159, is flash expanded to the operating pressure of demethanizer 17 by expansion valve 29. A portion of the stream is vaporized, further cooling stream 159*a* to −104° F. before it is supplied to fractionation tower 17 at a mid-column feed position. The cold liquid in stream 159*a* serves as reflux to absorb and condense the $C_2$ components, $C_3$ components, and heavier components rising in the upper region of demethanizer 17.

The recompressed and cooled distillation stream 39*e* is divided into two streams. One portion, stream 153, is the volatile residue gas product. The other portion, recycle stream 151, flows to heat exchanger 22 where it is cooled to −21° F. by heat exchange with a portion (stream 156) of cool distillation stream 39*a*. The cooled recycle stream 151*a* then flows to exchanger 12 where it is cooled to −131° F. and substantially condensed by heat exchange with cold distillation stream 39. The substantially condensed stream 151*b* is then flash expanded by expansion valve 24 to the tower operating pressure, resulting in cooling of the total stream to −144° F. The expanded stream 151*c* is then supplied to fractionation tower 17 as the top column feed. The vapor portion of stream 151*c* combines with the vapors rising from the top fractionation stage of the column to form distillation stream 39, which is withdrawn from an upper region of the tower at −136° F.

Liquid product stream 42 exits the bottom of the tower at 60° F. based on a typical specification of a methane to ethane ratio of 0.05:1 on a molar basis in the bottom product. It is pumped to a pressure of approximately 515 psia in demethanizer bottoms pump 21, and the pumped liquid product is then warmed to 86° F. as it provides cooling of stream 31 in exchanger 10 before flowing to storage.

The demethanizer overhead vapor (stream 39) passes countercurrently to the incoming feed gas and recycle streams in heat exchanger 12 where it is heated to −29° F. (stream 39*a*), and in heat exchanger 22 and heat exchanger 10 where it is heated to 95° F. (stream 39*b*). The distillation stream is then re-compressed by compressor 15 (driven by expansion machine 14) and compressor 19, then cooled to 140° F. in cooler 20 (stream 39*e*). Stream 39*e* is split into the residue gas product (stream 153) and recycle stream 151 as described earlier before residue gas stream 153 flows to the sales gas pipeline at 765 psia.

A summary of stream flow rates and energy consumption for the process illustrated in FIG. 7 is set forth in the following Table V.

TABLE V (FIG. 7)
Stream Flow Summary - Lb. Moles/Hr

| Stream | Methane | Ethane | Propane | Butanes+ | Total |
|---|---|---|---|---|---|
| 31 | 62,369 | 13,440 | 7,291 | 2,082 | 87,844 |
| 32 | 43,883 | 5,746 | 1,775 | 245 | 53,241 |
| 33 | 18,486 | 7,694 | 5,516 | 1,837 | 34,603 |
| 34 | 13,902 | 1,820 | 562 | 78 | 16,866 |
| 37 | 29,981 | 3,926 | 1,213 | 167 | 36,375 |
| 158 | 10,699 | 4,453 | 3,193 | 1,063 | 20,027 |
| 159 | 7,787 | 3,241 | 2,323 | 774 | 14,576 |
| 39 | 74,150 | 808 | 1 | 0 | 76,574 |
| 151 | 12,419 | 135 | 0 | 0 | 12,825 |
| 153 | 61,731 | 673 | 1 | 0 | 63,749 |
| 42 | 638 | 12,767 | 7,290 | 2,082 | 24,095 |
| Recoveries* | | | | | |
| Ethane | 95.00% | | | | |
| Propane | 99.99% | | | | |
| Butanes+ | 100.00% | | | | |
| Power | | | | | |
| Residue Gas Compression | 26,744 | HP | | | |
| Refrigerant Compression | 17,139 | HP | | | |
| Total Compression | 43,883 | HP | | | |

*(Based on un-rounded flow rates)

A comparison of Tables II and V shows that, compared to the prior art, the present invention maintains essentially the same ethane recovery (95.00% versus 95.00%), propane recovery (100.00% versus 99.99%), and butanes+recovery (100.00% versus 100.00%). However, comparison of Tables II and V further shows that these yields were achieved with substantially lower power requirements than those of the prior art process. The total power requirement of the present invention is 12% lower than that of the FIG. 2 process.

As with the FIG. 3 and FIG. 4 embodiments of the present invention, the supplemental rectification provided by subcooled liquid stream 159*a* reduces the amount of $C_2$ components, $C_3$ components, and $C_4$+ components contained in the vapors rising in the upper region of fractionation column 17. This embodiment of the present invention is able to cool more than 40% of the liquid from separator 11 and use it as reflux (stream 159*a*) above stream 37*a*. This allows operating separator 11 at a warmer temperature, so that there is a corresponding increase in the flow rate of stream 37 to work expansion machine 14. This in turn increases the refrigeration generated by the process and reduces the external power consumption of compressor 19.

Figure 8:
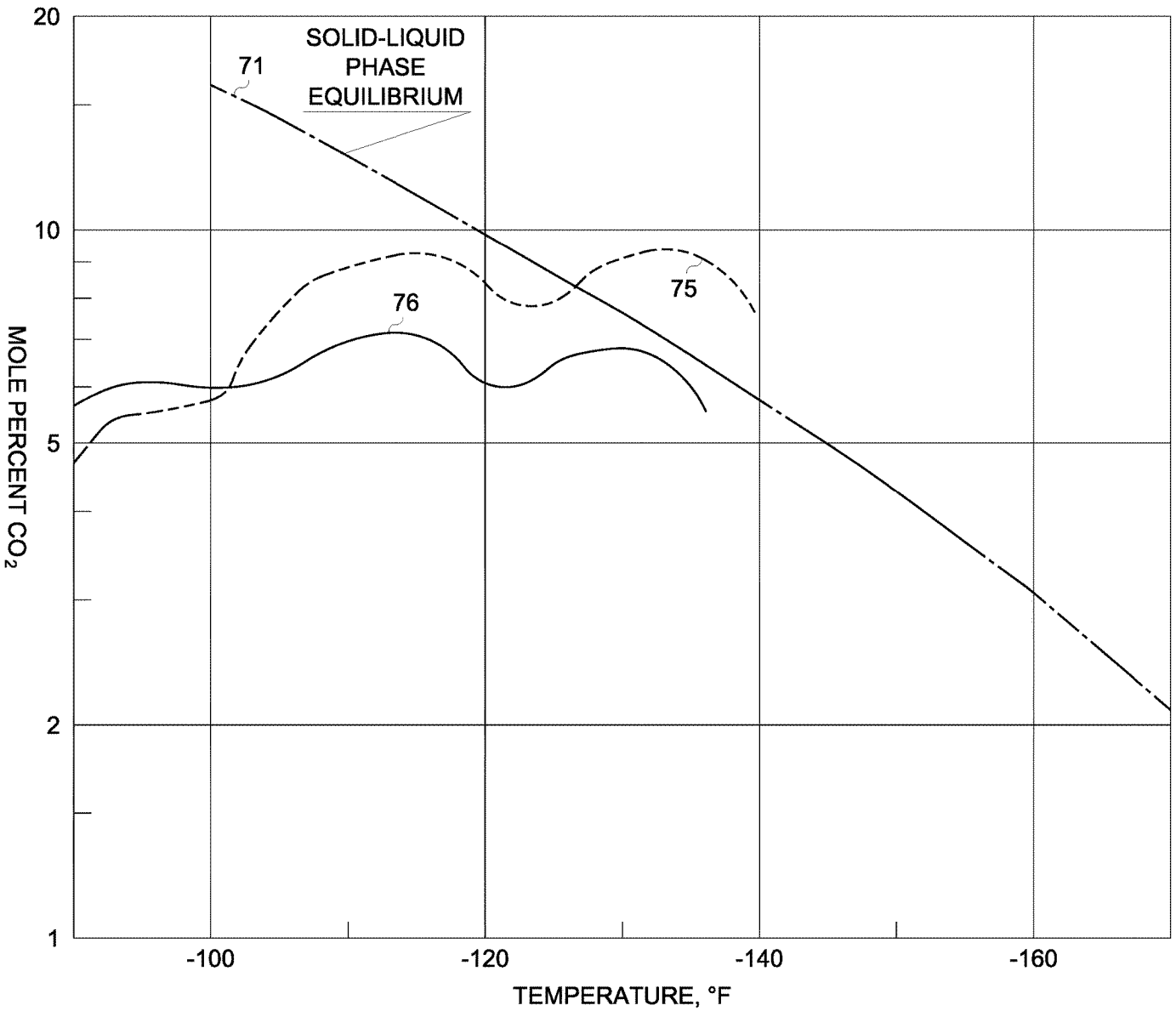

This embodiment of the present invention also reduces the likelihood of carbon dioxide freezing compared to the prior art of FIG. 2. FIG. 8 is another graph of the relation between carbon dioxide concentration and temperature, with line 71 as before representing the equilibrium conditions for solid and liquid carbon dioxide in methane and line 75 representing the conditions for the liquids on the fractionation stages of demethanizer 17 in the prior art process of FIG. 2. As can be seen, a portion of this operating line lies above the liquid-solid equilibrium line, indicating that the prior art FIG. 2 process cannot be operated at these conditions without encountering carbon dioxide freezing problems. As a result, it is not possible to use the FIG. 2 process under these conditions, so the prior art FIG. 2 process cannot actually achieve the recovery efficiencies stated in Table II in practice without removal of at least some of the carbon dioxide from the feed gas. This would, of course, substantially increase capital cost.

Line 76 in FIG. 8 represents the conditions for the liquids on the fractionation stages of demethanizer 17 in the FIG. 7 embodiment of the present invention, and shows a safety factor of 1.1 between the anticipated operating conditions and the carbon dioxide freezing conditions. Thus, this embodiment of the present invention could tolerate an increase of 10% in the concentration of carbon dioxide without risk of freezing. In practice, this improvement in the freezing safety factor could be used to advantage by operating the demethanizer at lower pressure (i.e., with colder temperatures on the fractionation stages) to raise the $C_2$+ component recovery levels still higher without encountering freezing problems.

The invention claimed is:

1. A process for separating a feed gas into a volatile residue gas fraction and a less volatile fraction, said feed gas containing hydrocarbons, methane and $C_2$ components together comprising said feed gas, wherein a. said feed gas is cooled under pressure to form. a liquid stream under pressure and a vapor stream under pressure;

b. said vapor stream is divided to form a first stream and a second stream;

c. said first stream is expanded to a lower pressure to form an expanded first stream, whereupon said expanded first stream is supplied to a distillation column at a mid-column feed position;

d. said second stream is cooled to condensation and expanded to said lower pressure to form an expanded cooled second stream;

e. said liquid stream is cooled to form a subcooled liquid stream, and said suhcooled liquid stream is divided into a first portion and a second portion;

f. said first portion is expanded to said lower pressure and heated to form a heated expanded first portion, thereby to supply at least a portion of said cooling in step e, whereupon said heated expanded first portion is supplied to said distillation column at a lower mid-column feed position;

g. said second portion is expanded to said lower pressure to form an expanded second portion;

h. said expanded cooled second stream is combined with said expanded second portion to form a combined stream, whereupon said combined stream is supplied to said distillation column at a top feed position;

i. said combined stream, said expanded first stream, and said heated expanded first portion are fractionated in said distillation column at said lower pressure to form a distillation vapor stream and said less volatile fraction;

j. said distillation. vapor stream is heated to form said volatile, residue gas fraction, thereby to supply at least portion of said cooling in steps a and d; and k. the quantities and temperatures of said feed streams to said distillation column are effective to maintain the overhead temperature of said distillation column at a temperature whereby said $C_2$ components are recovered in said less volatile fraction.

2. The process of claim 1 wherein a. said expanded first stream is combined with said expanded second portion to form said combined stream, whereupon said combined stream is supplied to said distillation column at said mid-column feed position; and b. said expanded cooled second stream is supplied to said distillation column at said. top feed position.

3. The process of claim 1 wherein a. said expanded second portion is supplied to said distillation column at an upper mid-column feed position, said upper mid-column feed position being below said top feed position and above said mid-column feed position; and b. said expanded cooled second stream is supplied to said distillation column at said top feed position.

4. The process of claim 1 wherein (i) said distillation vapor stream is heated to form a heated distillation vapor stream, thereby to supply at least a portion of said cooling in steps a and d;

(ii) said heated distillation vapor stream is compressed and cooled to form a cooled compressed distillation vapor stream;

(iii) said cooled compressed distillation vapor stream is divided to form said volatile residue gas fraction and a recycle stream;

(iv) said recycle stream is cooled to condensation to form a cooled recycle stream, thereby to supply at least a portion of said heating in step (i);

(v) said cooled recycle stream is expanded to said lower pressure to form an expanded cooled recycle stream, whereupon said expanded cooled recycle stream is supplied to said distillation column at said top feed position; and (vi) said combined stream is supplied to said distillation column at an upper mid-colunin feed position, said upper mid-column feed position being below said top feed position and above said mid-column feed position.

5. The process of claim 4 wherein a. said expanded first stream is combined with said expanded second portion to form said combined stream, whereupon said combined stream is supplied to said distillation column at said mid-column feed position; and b. said expanded cooled second stream is supplied to said distillation column at said upper mid-column feed position.

6. The process of claim 4 wherein a. said expanded second portion is supplied to said distillation column at an intermediate upper mid-column feed position, said intermediate upper mid-column feed position being below said upper inid-column feed position and above said mid-column feed position; and.

b. said expanded cooled second stream is supplied to said distillation column at said. upper mid-column feed position.

7. The process of claim 1 wherein (i) said second portion is cooled under pressure;

(ii) said cooled second portion is expanded to said lower pressure to form said expanded second portion; and (iii) said heating of said distillation vapor stream supplies at least a portion of said cooling in step (i).

8. The process of claim 2 wherein (i) said second portion is cooled under pressure;

(ii) said cooled second portion is expanded to said lower pressure to form said expanded second portion; and (iii) said heating of said distillation vapor stream supplies at least a portion of said cooling in step (i).

9. The process of claim 3 wherein (i) said second portion is cooled under pressure;

(ii) said cooled second portion is expanded to said lower pressure to form said expanded second portion; and (iii) said heating of said distillation vapor stream supplies at least a portion of said cooling in step (i).

10. An apparatus for separating a feed gas into a volatile residue gas fraction and a less volatile fraction, said feed gas containing hydrocarbons, methane and $C_2$ components together comprising said feed gas, said apparatus including a. a first heat exchange means comprising a first heat exchanger to receive said feed gas under pressure and cool said feed gas to partially condense it to form a partially condensed stream;

b. a separation means comprising a separation column connected to said first heat exchange means to receive said partially condensed stream under pressure and separate said partially condensed stream into a liquid stream and a vapor stream;

c. a first dividing means comprising a piping tee connected to said separation means to receive said vapor stream and divide said vapor stream into a first stream and a second stream;

d. a first expansion means comprising an expansion machine connected to said first dividing means to receive said first stream and expand said first stream to a lower pressure to form an expanded first stream;

e. a distillation column. connected to receive said expanded first stream at a mid-column feed position;

f. a second heat exchange means comprising a second heat exchanger connected to said first dividing means to receive said second stream and cool said second stream to condensation to form a cooled second stream;

g. a second expansion means comprising an expansion valve connected to said second heat exchange means to receive said cooled second stream and expand said cooled second stream to said lower pressure to form an expanded cooled second stream;

h. a third heat exchange means comprising a third heat exchanger connected to said separation means to receive said liquid stream and cool said liquid stream to form a subcooled liquid stream;

i. a second dividing meanssomprising a piping tee connected to said third heat exchange means to receive said subcooled liquid stream and divide said subcooled liquid stream into a first portion and a second portion;

j. a third expansion means comprising an expansion valve connected to said second dividing means to receive said first portion and expand said first portion to said lower pressure to form an expanded first portion;

k. said third heat exchange means further connected to said third expansion means to receive said expanded first portion and heat said expanded first portion to form a heated expanded first portion, thereby to supply at least a portion of said cooling of element h, said third heat exchange means further being connected to said distillation column connected to supply said heated expanded first portion to said distillation column at a lower mid-column feed position;

l. a fourth expansion means.commis* an expansion valve connected to said second dividing means to receive said second portion and expand said second portion to said lower pressure to form an expanded second portion, m. a combining means comprising a piping tee connected to said second expansion means and said fourth expansion means to receive said expanded cooled second stream and said expanded second portion and combine said expanded cooled second stream and said expanded second portion to form a combined stream, said combining means being further connected to said distillation column to supply said combined stream to said distillation column at a top feed position, n. said distillation. column being adapted to fractionate said combined stream;said expanded first stream, and said heated expanded first portion at said lower pressure to form a distillation vapor stream and said less volatile fraction; and o. said distillation colimm being further connected to said second heat exchange means and said second heat exchange means being further connected to said first heat exchange means to receive said distillation vapor stream and heat said distillation vapor stream to form said volatile residue gas fraction, thereby to supply at least a portion of said cooling of elements a and f.

11. The apparatus according to claim 10 wherein a. said combining means is adapted to be connected to said first expansion means and said fourth expansion means to receive said expanded first stream and said expanded second portion and combine said expanded first stream and said expanded second portion to form said combined stream, said combining means being further adapted to supply said combined stream to said distillation column at said mid-column. feed position; and b. said second expansion means is adapted to be connected to said distillation column to supply said expanded cooled second stream to said distillation column at said top feed positi on.

12. The apparatus according to claim 10 wherein a. said fourth expansion means is adapted to be connected to said distillation column at an upper mid-column feed position, said upper mid-column feed position being below said top feed position and above said mid-column feed position, thereby to supply said expanded second portion to said distillation column at said upper mid-column feed position; and b. said second expansion means is adapted to be connected to said distillation column to supply said expanded cooled second stream to said distillation column at said top feed position.

13. The apparatus according to claim 10 wherein (i) said second heat exchange means and said first heat exchange means are adapted to heat said distillation vapor stream to form a heated distillation. vapor stream, thereby to supply at least a portion of said cooling of elements a and f;

(ii) a compressing and cooling means comprising a compressor and a cooler is connected to said first heat exchange means to receive said heated distillation vapor stream and compress to higher pressure and cool said heated distillation vapor stream to form a cooled compressed distillation vapor stream;

(iii) a third dividing in.eanscomprising a piping, tee is connected to said compressing and cooling means to receive said cooled compressed distillation vapor stream and divide said cooled compressed distillation vapor stream into said volatile residue gas fraction and a recycle stream;

(iv) said first heat exchange means is further connected to said third dividing means and said second heat exchange means is further connected to said first heat exchange means to receive said recycle stream and cool said recycle stream to condensation to form a cooled recycle stream, thereby to supply at least a portion of said heating of element (i);

(v) a fifth expansion means comprising an expansion valve is connected to said second heat exchange means to receive said cooled recycle stream and expand said cooled recycle stream to said lower pressure to form an expanded cooled recycle stream, said fifth expansion means being further connected to said distillation column to supply said expanded cooled recycle stream to said distillation column at said top feed position; and (vi) said combining means is adapted to be connected to said distillation column at an upper raid-column feed position, said upper mid-column feed position being bOlow said top feed position and above said mid-column feed position, thereby to supply said combined stream to said distillation column at said upper mid-column feed position.

14. The apparatus according to claim 13 wherein a. said combining means is adapted to be connected to said second s and said fourth expansion means to receive said expanded first stream and said expanded second portion and combine said expanded first stream and said expanded second portion to form said combined stream, said combining means being further adapted to supply said combined stream to said distillation column at said mid-column. feed position; and b. said second expansion means is adapted to be connected to said distillation column to supply said expanded cooled second stream to said distillation column at said upper mid-column feed position.

15. The apparatus according to claim 13 wherein a. said fourth expansion means is adapted to be connected to said distillation column at an intermediate upper inid-column feed position, said intermediate upper mid-column feed position being below said upper mid-column. feed position and above said mid-column feed position, thereby to supply said expanded second portion to said distillation column at said intermediate upper mid-column feed position; and b. said second expansion means is adapted to be connected to said distillation column to supply said expanded cooled second stream to said distillation column at said upper mid-column feed position.

16. The apparatus according to claim 10 wherein (i) said second heat exchange means is adapted to have an additional cooling pass that is connected to said second dividing means to receive said second portion and cool said second portion under pressure to form a cooled second portion;

(ii) said fourth expansion means is adapted to be connected to said second heat exchange means to receive said cooled second portion and expand said cooled second portion to said lower pressure to form said expanded second portion; and.

(iii) said heating of said distillation vapor stream in said second heat exchange means supplies at least a portion of said cooling of element (i).

17. The apparatus according to claim 11 wherein (i) said second heat exchange means is adapted to have an additional cooling pass that is connected to said second dividing means to receive said second portion and cool said second portion under pressure to form a cooled second portion;

(ii) said fourth expansion means is adapted to be connected to said second heat exchange means to receive said cooled second portion and expand said cooled second portion to said lower pressure to form said expanded second portion; and (iii) said heating of said distillation vapor stream in said second heat exchange means supplies at least a portion of said cooling of element (i).

18. The apparatus according to claim 12 wherein (i) said second heat exchange means is adapted to have an additional cooling pass that is connected to said second dividing means to receive said second portion and cool said second portion under pressure to form a cooled second portion;

(ii) said fourth expansion means is adapted to be connected to said second heat exchange means to receive said cooled second portion and expand said cooled second portion to said lower pressure to form said expanded second portion; and (iii) said heating of said distillation vapor stream in said second heat exchange means supplies at least a portion of said cooling of element (i).

* * * * *